US005588175A

United States Patent [19]

Zahner

[11] Patent Number: 5,588,175

[45] Date of Patent: Dec. 31, 1996

[54] FOOT VACUUM

[76] Inventor: John Zahner, 61-32 233rd St., Bayside, N.Y. 11364

[21] Appl. No.: 438,103

[22] Filed: May 8, 1995

[51] Int. Cl.[6] ..... A47L 5/38

[52] U.S. Cl. ..... 15/310; 15/301; 15/302; 15/246.3

[58] Field of Search ..... 15/301, 310, 311, 15/246.3

[56] References Cited

U.S. PATENT DOCUMENTS

| | | | |
|---|---|---|---|
| 1,359,193 | 11/1920 | Parker | 15/311 |
| 1,361,068 | 12/1920 | Karro | 15/311 |
| 2,860,366 | 11/1958 | Kemp | 15/311 |
| 3,023,689 | 3/1962 | Kurek | 15/310 X |
| 3,786,531 | 1/1974 | Borg | 15/310 |

FOREIGN PATENT DOCUMENTS

| | | | |
|---|---|---|---|
| 1421110 | 11/1965 | France | 15/311 |
| 1108869 | 6/1961 | Germany | 15/311 |
| 674433 | 11/1964 | Italy | 15/311 |

OTHER PUBLICATIONS

No–Shoe–Cleaner Does A Better Job Than This One page from J. Z. Machine Tool Co. Inc.—origin not presently known.

*Primary Examiner*—Chris K. Moore
*Attorney, Agent, or Firm*—Richard L. Miller, P.E.

[57] ABSTRACT

A shoe soil removing device that includes a hollow housing, a manifold, a motor, and low pressure apparatus. The hollow housing has a hollow housing open top. The manifold is disposed within the hollowing housing and has a manifold open top. The motor is disposed within the hollow housing. And the low pressure apparatus creates a low pressure area at the motor so that an air flow can be established from the hollow housing open top to the motor.

5 Claims, 1 Drawing Sheet

FIG. 1
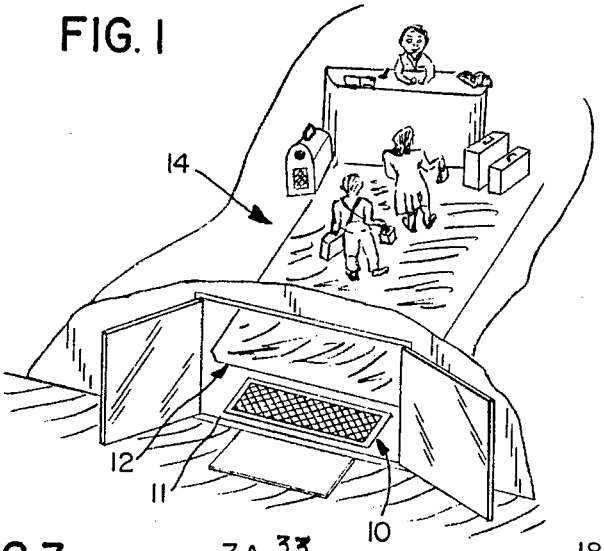
FIG. 2
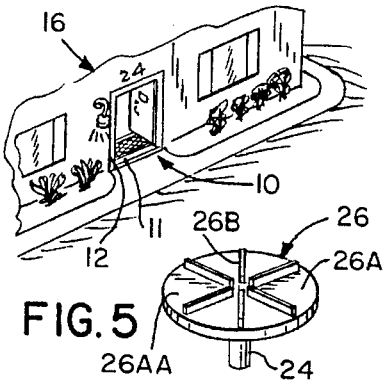
FIG. 5
FIG. 3
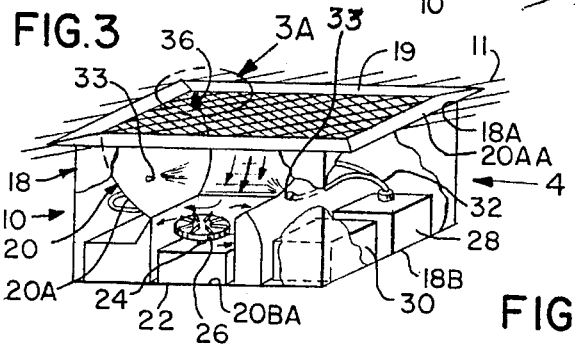
FIG. 4
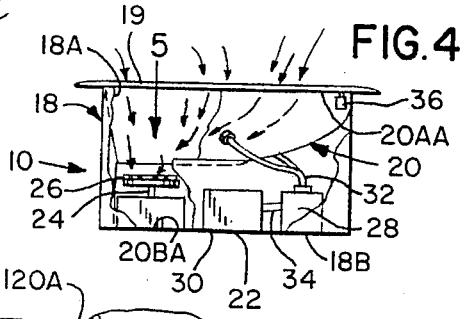
FIG. 7
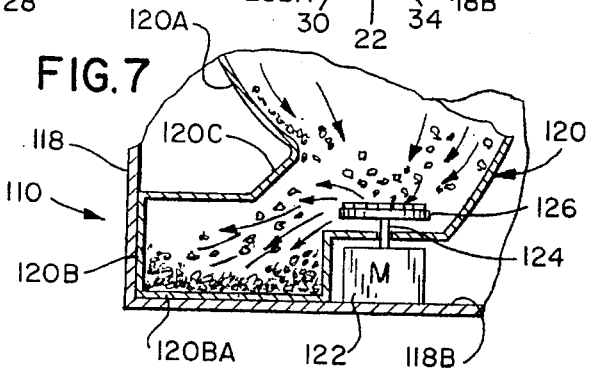
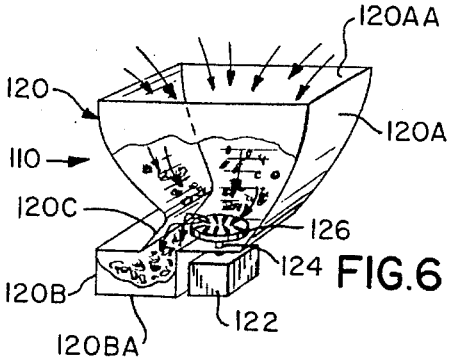
FIG. 6
FIG. 3A
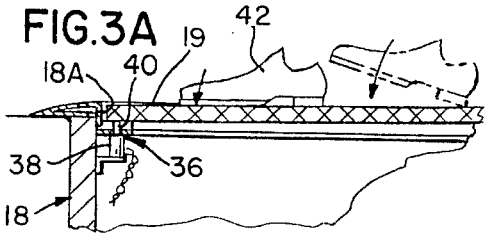
FIG. 8
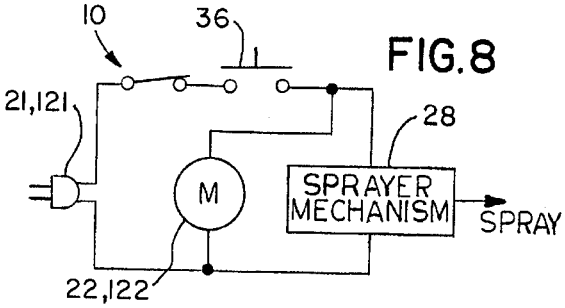

FOOT VACUUM

BACKGROUND OF THE INVENTION

The present invention relates to a foot vacuum. More particularly, the present invention relates to a foot vacuum that is completely self-contained.

Numerous innovations for foot vacuums have been provides in the prior art that are adapted to be used in various ways. Furthermore, even though these innovations may be suitable for the specific individual purposes to which they address, they would not be suitable for the purposes of the present invention as heretofore described.

SUMMARY OF THE INVENTION

Accordingly, it is an object of the present invention to provide a foot vacuum that avoids the disadvantages of the prior art.

Another object of the present invention is to provide a foot vacuum that is simple and inexpensive to manufacture.

Still another object of the present invention is to provide a foot vacuum that is simple to operate.

Yet another object of the present invention is to provide a foot vacuum that includes a hollow housing, a manifold, a motor, and low pressure apparatus.

Still yet another object of the present invention is to provide a foot vacuum wherein the hollow housing has a hollow housing open top.

Yet still another object of the present invention is to provide a foot vacuum wherein the manifold is disposed within the hollowing housing and has a manifold open top.

Still yet another object of the present invention is to provide a foot vacuum wherein the motor is disposed within the hollow housing.

Yet still another object of the present invention is to provide a foot vacuum wherein the low pressure apparatus creates a low pressure area at the motor so that an air flow can be established from the hollow housing open top to the motor.

Still yet another object of the present invention is to provide a foot vacuum that further includes spraying apparatus.

Yet still another object of the present invention is to provide a foot vacuum wherein the spraying apparatus includes a sprayer, a spray reservoir for storing a spray, at least one spray tube that connects the sprayer to the manifold, and a spray nozzle that is disposed on the at least one spray tube where each of the at least one spray tube meets the manifold.

Still yet another object of the present invention is to provide a foot vacuum wherein the low pressure apparatus includes a turbine connected by a shaft to the motor.

Yet still another object of the present invention is to provide a foot vacuum wherein the turbine and the motor are disposed within the manifold.

Still yet another object of the present invention is to provide afoot vacuum wherein the turbine is disposed in the manifold and the motor is disposed external to the manifold.

Yet still another object of the present invention s to provide a foot vacuum that further includes switching apparatus for selectively activating the motor and which is disposed within the hollow housing at the hollow housing open top.

Still yet another object of the present invention is to provide a foot vacuum wherein the switching apparatus includes a micro-switch and a resilient pad.

Finally another object of the present invention is to provide a foot vacuum wherein the turbine includes a substantially flat disk with an upper surface on which are disposed a plurality of turbine fins.

The novel features which are considered characteristic of the present invention are set forth in the appended claims. The invention itself, however, both as to it construction and it's method of operation, together with additional objects and advantages thereof, will be best understood from the following description of the specific embodiments when read and understood in connection with the accompanying drawing.

BRIEF DESCRIPTION OF THE DRAWING

FIG. 1 is a diagrammatic perspective view illustrating the instant invention installed in a hotel entrance;

FIG. 2 a diagrammatic perspective view illustrating the instant invention installed in a residential home;

FIG. 3 is a diagrammatic perspective view with parts broken away of a first embodiment of the instant invention per se;

FIG. 3A is a cross sectional view taken generally in the area of the dotted curve indicated by arrow 3A in FIG. 3 illustrating the cooperation between the grill and a micro-switch;

FIG. 4 is a side elevational view taken in the direction of arrow 4 in FIG. 3 with parts broken away so as to illustrate the flow of particles through the top grill;

FIG. 5 is a diagrammatic perspective view of the turbine blade per se;

FIG. 6 is a diagrammatic perspective view illustrating a portion of a second embodiment of the instant invention;

FIG. 7 is an enlarged diagrammatic partially sectioned view of FIG. 6; and FIG. 8 is a diagrammatic electrical schematic of the instant invention.

LIST OF REFERENCE NUMERALS UTILIZED IN THE DRAWING

Preferred Embodiment

10-foot vacuum
11-floor
12-entrance
14-hotel
16-residential home
18-hollow housing
18A-hollow housing open top
18B-hollow housing bottom
20-manifold
20A-manifold upper portion
20AA-manifold upper portion open top
20B-manifold lower portion
20BA-manifold lower portion bottom
21-power source
22-motor
24-shaft

26-turbine
26A-turbine disk
26AA-turbine disk low pressure side
26B-plurality of fins
28-sprayer
30-reservoir
32-at least tone sprayer tube
34-spray reservoir tube
36-micro-switch arrangement
38-micro-switch
40-plunger
42-shoe Alternate Embodiment

110-foot vacuum
118-hollow housing
118B-hollow housing bottom
120-manifold
120A-manifold upper portion
120AA-manifold upper portion open top
120B-manifold lower portion
120BA-manifold lower portion bottom
120C-manifold intermediate portion
121-power source
122-motor
124-shaft
126-turbine

DETAILED DESCRIPTION OF THE PREFERRED EMBODIMENT

Referring now to the figures in which like numerals indicate like parts, and particularly to FIGS. 1 and 2, the foot vacuum of the present invention is shown generally at 10, in the floor 11 of the entrance 12 to a hotel 14 or a residential home 16.

The structure of the foot vacuum 10 can best be seen in FIGS. 3,4 and 8, and as such, will be discussed with reference thereto. The foot vacuum 10 includes a hollow housing 18 with a hollow housing open top 18A and a hollow housing bottom 18B. The hollow housing 18 sits within the floor 11 with the hollow housing open top 18A substantially flush with the floor 11. A grill 19 covers the hollow housing open top 18A. Contained within the hollow housing 18 is a manifold 20. The manifold 20 has a manifold upper portion 20A with a manifold upper portion open top 20AA and a manifold lower portion 20B with a manifold lower portion bottom 20BA. The manifold upper portion 20A tapers towards the manifold lower portion 20B and can be integrally formed therewith, but is not limited to that. Additionally, the manifold 20 could be made from aluminum similar to that typically used in central HVAC ducts, but again is not limited to that.

The manifold 20 is so positioned within the hollow housing 18 so that the manifold lower portion bottom 20BA rests on the hollow housing bottom 18B and the manifold upper portion open top 20AA is flush with the hollow housing open top 18A.

Contained within the manifold lower portion 20B is a motor 22 which is powered from a conventional AC source 21 and from which extends a shaft 24. Attached to the shaft 24 is a turbine 26 which turns therewith.

Disposed external to the manifold 20 but still internal to the hollow housing 18 is a sprayer 28 and a sprayer reservoir 30. The sprayer 28 is in fluid communication with the manifold upper portion 20A, via at least one sprayer tube 32 which carries spray therethrough and exits at sprayer nozzles 33. A sprayer reservoir tube 34 fluidly connects the sprayer reservoir 30 to the sprayer 28 and provides spray thereto. A micro-switch arrangement 34 is disposed at the hollow housing open top 18A and is in mechanical communication with the grill 19.

The configuration of the turbine 26 can best be seen in FIG. 5, and as such, will be discussed with reference thereto. The turbine 26 has a turbine disk 26A which is substantially disk shaped, but is not limited to that. The turbine disk 26A has a turbine disk low pressure side 26AA from which emanate a plurality of turbine fins 26B. The pitch of the plurality of turbine fins 26B are so designed so that in conjunction with the proper direction of rotation of the turbine disk 26A, a low pressure area is provided at the turbine disk lower pressure side 26AA. This low pressure area provides a vacuum to which soil from a user shoes is attracted.

The configuration of the micro-switch arrangement 36 can best be seen in FIG. 3A, and as such, will be discussed with reference thereto. The micro-switch assembly 36 includes a micro-switch 38 and a foam pad 40. The micro-switch 38 is mounted within the hollow housing 18 at the hollow housing open top 18A with its plunger passing through a hole contained within the foam pad 40. The plunger contacts the bottom of the grill 19 and is prevented from retraction by the presence of the foam pad 40. The foam pad 40 is disposed between the micro-switch 38 and the grill 19 and is in contact with the grill 19. The plunger of the micro-switch 38 extends vertically through the hole contained in the foam pad 40 and contacts the grill 19. With the foam pad 40 being in contact with the grill 19, the foam pad 40 supports the weight of the grill 19 and allows the plunger of the micro-switch 38 to be maintained extended. The plunger of the micro-switch 38 is prevented from retraction until the grill 19 is intentionally stepped on by the person which causes the foam pad 40 to compress and allow the plunger of the micro-switch 38 to retract.

In operation, when a user stops on the grill 19, the pressure of his foot 42 retracts the plunger of the micro-switch 38 which in turn closes the micro-switch 38. The closed micro-switch 38 activates the motor 22. The rotating motor 22, via the shaft 24, rotates the turbine 26. The rotating turbine 26 creates a low pressure area which causes an air flow thereto, that is, an air flow from the hollow housing open top 18A to the manifold lower portion 20B. The centrifugal force created by the rotating turbine 26 carries any soil in the air flow that was located on the bottom of the user shoe 42 to the manifold lower portion 20B where the soil is stored for eventual removal. Since the internal workings of the foot vacuum 10 are completely contained within the hollow housing 18, no soil will escape into the atmosphere during use. Additional to and simultaneous with the aforementioned soil removing function, the sprayer 28 is also activated for a predetermined time, via a timer (not shown), and sprays a disinfectant stored in the reservoir 30 through the at least one sprayer tube 32 onto the bottom of the user shoe 42 and disinfects same. Thus, the user shoe 42 is free of soil in addition to being disinfected.

An alternate embodiment of the foot vacuum 110 can best can best be seen in FIGS. 6,7 and 8, and as such, will be described with reference thereto. The foot vacuum 110 includes a hollow housing 118 with a hollow housing open top (not shown) and a hollow housing bottom 118B. The hollow housing 118 sits within the floor (not shown) with the hollow housing open top flush with the floor. A grill (not shown) covers the hollow housing open top. Contained within the hollow housing 118 is a manifold 120. The manifold 120 has a manifold upper portion 120A with a manifold upper portion open top 120AA, a manifold lower portion 120B with a manifold lower portion bottom 120BA, and a manifold intermediate portion 120C. The manifold upper portion 120A tapers towards the manifold intermediate portion 120C and can be integrally formed therewith, but is not limited to that. Additionally, the manifold 120 could be made from aluminum similar to that of central HVAC ducts, but again is not limited to that.

The manifold 120 is so positioned within the hollow housing 118 so that the manifold lower portion bottom 120BA rests on the hollow housing bottom 118B and the manifold upper portion open top 120AA is flush with the hollow housing open top 118A.

Disposed external to the manifold lower portion 120B is a motor 122 which is powered from a conventional AC source 121 and from which extends a shaft 124 that passes into the manifold intermediate portion 120C. Attached to the shaft 124 is a turbine 126 which turns therewith.

Disposed external to the manifold 120 but still internal to the hollow housing 118 is a sprayer (not shown) and a sprayer reservoir (not shown). The sprayer is in fluid communication with the manifold upper portion 120A, via at least one sprayer tube (not shown) which carries spray therethrough and exits at sprayer nozzles (not shown). A sprayer reservoir tube (not shown) fluidly connects the sprayer reservoir to the sprayer and provides spray thereto.

A micro-switch arrangement (not shown) is disposed at the hollow housing open top 118A and is in mechanical communication with the grill.

It will understood that each of the elements described above, or two or more together, may also find a useful application in other types of constructions differing from the types described above.

While the invention has been illustrated and described as embodied in a foot vacuum, it is not intended to be limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior at, fairly constitute characteristics of the generic or specific aspects of this invention.

What is claimed as new and desired to be protected by Letters Patent is set forth in the appended claims.

The invention claimed is:

1. A self-contained shoe soil removing device installable in a floor of a structure and being able to internally maintain soil having a weight being removed from a shoe of a person stepping thereon, comprising:

a) a hollow and rectangular-parallelepiped-shaped housing having a rectangular-parallelepiped-shape, so that said self-contained shoe soil removing device can be easily stacked, stored, displayed, transported, and installed in, and removed out of, the floor of the structure as a result of its regular shape that is free of obstructions that could unintentionally engage the floor during installation and removal; said hollow and rectangular-parallelepiped-shaped housing being positionable in the floor of the structure and containing a single chamber; said hollow and rectangular-parallelepiped-shaped housing having an open top being flush with the floor of the structure when said hollow and rectangular-parallelepiped-shaped housing is positioned in the floor of the structure, a flat, closed, and horizontally-oriented bottom disposed below said open top of said hollow and rectangular-parallelepiped-shaped housing, and a closed and vertically-oriented side extending vertically perpendicularly upwardly from an end of said flat, closed, and horizontally-oriented bottom of said hollow and rectangular-parallelepiped-shaped housing;

b) a grill having a weight and covering said open top of said hollow and rectangular-parallelepiped-shaped housing and being contactable by the shoe of the person stepping thereon;

c) a hollow manifold contained in said hollow and rectangular-parallelepiped-shaped housing; said hollow manifold having:

i) a hollow and vertically-downwardly-tapering upper portion with a wide open top being flush with said open top of said hollow and rectangular-parallelepiped-shaped housing, a narrow open bottom being disposed below, and narrower than, said wide open top of said hollow and vertically-downwardly-tapering upper portion of said hollow manifold, and a side with at least one throughbore extending therethrough;

ii) a hollow, horizontally-laterally-oriented, and parallelogram-shaped intermediate portion extending horizontally-laterally-outwardly from below, and being in fluid communication with, said hollow and vertically-downwardly-tapering upper portion of said hollow manifold; said hollow, horizontally-laterally-oriented, and parallelogram-shaped intermediate portion of said hollow manifold having an open top being coincident with said narrow open bottom of said hollow and vertically-downwardly-tapering upper portion of said hollow manifold, a first closed side being collinear with a side of said hollow and vertically-downwardly-tapering upper portion of said hollow manifold, a second closed side being parallel to said first closed side of said hollow, horizontally-laterally-oriented, and parallelogram-shaped intermediate portion of said hollow manifold and extending outwardly from an opposite side of said hollow and vertically-downwardly-tapering upper portion of said hollow manifold, and a partially open bottom being disposed below said open top of said hollow, horizontally-laterally-oriented, and parallelogram-shaped intermediate portion of said hollow manifold and having an open portion and a horizontally-oriented closed portion with a vertically-oriented throughbore extending vertically therethrough; and iii) a hollow and rectangular-parallelepiped-shaped lower portion extending horizontally-laterally-outwardly from below, in the same direction as, and in fluid communication with, said hollow, horizontally-laterally-oriented, and parallelogram-shaped intermediate portion of said hollow manifold; said hollow and rectangular-parallelepiped-shaped lower portion of said hollow manifold having a partially open top with an open portion being coincident with said open portion of said partially open bottom of said hollow, horizontally-laterally-oriented, and parallelogram-shaped intermediate portion of said hollow manifold, a closed and horizontally-oriented bottom disposed below said open top of said hollow and rectangular-parallelepiped-shaped lower portion of said hollow manifold and resting completely on said flat, closed, and horizontally-oriented bottom of said hollow and rectangular-parallelepiped-shaped housing so as to be reinforced thereby, and a closed and vertically-oriented side extending vertically-perpendicularly-upwardly from an end of said closed and horizontally-oriented bottom of said hollow and rectangular-parallelepiped-shaped lower portion of said hollow manifold and abutting completely against said closed and vertically-oriented side of said hollow and rectangular-parallelepiped-shaped housing so as to be reinforced thereby, so that said hollow and rectangular-parallelepiped-shaped lower portion of said hollow manifold can withstand the weight of the soil being deposited and stored therein for eventual removal therefrom;

d) a motor contained in said hollow and rectangular-parallelepiped-shaped housing, external to said hollow manifold, so that the soil flowing through said hollow manifold does not contact said motor and cause damage thereto; said motor resting on said flat, closed, and horizontally-oriented bottom of said hollow and rectangular-parallelepiped-shaped housing so as to be supported thereby;

e) motor activating means for selectively starting and stopping said motor; said motor activating means contained in said hollow and rectangular-parallelepiped-shaped housing and contacting said grill and being in electrical communication with said motor;

f) a vertically oriented shaft connected to, and extending vertically upwardly from, said motor and passing vertically through said vertically-oriented throughbore in said horizontally-oriented closed portion of said partially open bottom of said hollow, horizontally-laterally-oriented, and parallelogram-shaped intermediate portion of said hollow manifold; and g) a horizontally-oriented turbine contained in said hollow, horizontally-laterally-oriented, and parallelogram-shaped intermediate portion of said hollow manifold and being attached directly to said shaft for rotation therewith, so that when the person steps on said grill, said motor activating means causes said motor to start and rotate, which in turn causes said shaft to rotate, which in turn causes said horizontally-oriented turbine to horizontally rotate in said hollow, horizontally-laterally-oriented, and parallelogram-shaped intermediate portion of said hollow manifold and create a low pressure area thereat which causes a vacuum to be created thereat that creates an air flow thereto that causes the soil from the shoe of the person stepping on the grill to be removed and directed downwardly through said hollow and vertically-downwardly-tapering upper portion of said hollow manifold to said hollow, horizontally-laterally-oriented, and parallelogram-shaped intermediate portion of said hollow manifold where the centrifugal force created by the rotation of said horizontally-oriented turbine throws the soil horizontally outwardly through said hollow, horizontally-laterally-oriented, and parallelogram-shaped intermediate portion of said hollow manifold to said open portion of said partially open top of said hollow and rectangular- parallelepiped-shaped lower portion of said hollow manifold where gravity directs the soil downwardly in said hollow and rectangular-parallelepiped- shaped lower portion of said hollow manifold where the soil is deposited and isolated from disturbances created by the rotation of said horizontally-oriented turbine and stored for eventual removal therefrom without escaping into the atmosphere since said hollow manifold is completely contained within said hollow and rectangular-parallelepiped-shaped housing.

2. The vacuum as defined in claim 1, wherein said hollow manifold is aluminum, so that no corrosion thereof will occur.

3. The vacuum as defined in claim 1, wherein said motor activating means includes:

a) a micro-switch that is contained in, and attached to, said hollow and rectangular-parallelepiped-shaped housing, at said open top of said hollow and rectangular-parallelepiped-shaped housing with said grill resting on a vertically-oriented plunger thereof; and b) a foam pad that is disposed between said micro-switch of said motor activating means and said grill, and has a vertically-oriented throughbore that extends vertically therethrough that receives said vertically-oriented plunger of said micro-switch of said motor activating means, so that said foam pad supports said weight of said grill and allows said vertically-oriented plunger of said micro-switch of said motor activating means to be maintained extended and prevents the unintentional retraction of said vertically-oriented plunger of said micro-switch of said motor activating means until said grill is intentionally stepped on by the person which causes said foam pad to compress and allow said vertically-oriented plunger of said micro-switch of said motor activating means to retract.

4. The vacuum as defined in claim 1, wherein said horizontally-oriented turbine has a direction of rotation and a flat circular disk with an upper surface that has a plurality of fins extending vertically- upwardly therefrom, into said low pressure area in said hollow, horizontally-laterally-oriented, and parallelogram-shaped intermediate portion of said hollow manifold, at a pitch in conjunction with said direction of rotation of said horizontally-oriented turbine, that is sufficient to create said low pressure area in said hollow, horizontally-laterally-oriented, and parallelogram-shaped intermediate portion of said hollow manifold.

5. A vacuum as defined in claim 1; further comprising spraying means for spraying a disinfectant into said hollow and vertically-downwardly-tapering upper portion of said hollow manifold and onto the shoe of the person stepping on said grill for disinfecting the shoe of the person; said spraying means being completely contained in said hollow and rectangular-parallelepiped-shaped housing, so that said spraying means is self-contained in said foot vacuum; said spraying means including:

a) a disinfectant reservoir for storing said disinfectant and being contained in said hollow and rectangular-parallelepiped-shaped housing, external to said hollow manifold, so that the soil flowing through said hollow manifold does not contact said disinfectant reservoir of said spraying means and cause damage thereto; said disinfectant reservoir of said spraying means resting on said flat, closed, and horizontally-oriented bottom of said hollow and rectangular-parallelepiped-shaped housing so as to be supported thereby;

b) a sprayer contained in said hollow and rectangular-parallelepiped-shaped housing, external to said hollow manifold, so that the soil flowing through said hollow manifold does not contact said sprayer of said spraying means and cause damage thereto; said sprayer of said spraying means resting on said flat, closed, and horizontally-oriented bottom of said hollow and rectangular-parallelepiped-shaped housing so as to be supported thereby; said sprayer of said spraying means being in fluid communication with said disinfectant reservoir of said spraying means via a reservoir tube, so that said disinfectant contained in said disinfectant reservoir of said spraying means can flow from said disinfectant reservoir of said spraying means, through said reservoir tube, to said sprayer of said spraying means; said sprayer of said spraying means being in electrical communication with said motor activating means, so that when the person steps on said grill, said motor activating means causes said sprayer to spray said disinfectant for a predetermined time that is governed by an internal timer; and c) at least one spray nozzle; each nozzle of said at least one spray nozzle of said spraying means being disposed in a respective throughbore of said at least one throughbore in said side of said hollow and vertically-downwardly-tapering upper portion of said hollow manifold, and being in fluid communication with said sprayer of said spraying means via a spray tube, so that said disinfectant that is sprayed by said sprayer of said spraying means can flow from said sprayer of said spraying means, through said spray tube, to said at least one spray nozzle of said spraying means and be ejected thereby into said hollow and vertically-downwardly-tapering upper portion of said hollow manifold and onto the shoe of the person stepping on said grill so as to disinfect the shoe of the person.

* * * * *